United States Patent [19]

Winders et al.

[11] Patent Number: 4,899,990

[45] Date of Patent: Feb. 13, 1990

[54] FENCE-TIE

[76] Inventors: Gerald W. Winders, 2118 Camwood Ave., Rowland Heights, Calif. 91748; Michael S. LeBlanc, 15950 Padova Dr., Hacienda Heights, Calif. 91745

[21] Appl. No.: 295,772

[22] Filed: Jan. 10, 1989

[51] Int. Cl.[4] ..... B21F 27/00

[52] U.S. Cl. ..... 256/57; 403/397; 47/44; 174/173

[58] Field of Search ..... 256/57, 71; 403/397; 174/173; 47/44

[56] References Cited

U.S. PATENT DOCUMENTS

| | | | |
|---|---|---|---|
| 201,744 | 3/1878 | Butler | 256/57 |
| 1,849,410 | 3/1932 | Selquist | 256/57 X |
| 2,251,644 | 8/1941 | Tunnerman | 256/57 X |
| 2,907,553 | 10/1959 | Cookman | 256/57 |
| 3,169,750 | 2/1965 | Weed | 256/57 |
| 3,246,880 | 4/1966 | Weed | 256/57 |
| 3,394,922 | 7/1968 | Bradbury | 256/57 |
| 4,270,581 | 6/1981 | Claxton et al. | 256/57 X |

*Primary Examiner*—Andrew V. Kundrat

[57] ABSTRACT

The subject invention is a fence-tie formed of a substantially rigid yet deformable material formed as a wire and comprising a substantially straight body having two ends. The first end is formed into a hook and the second end is bent at an angle between approximately 90 and approximately 135 degrees from the body of the fence-tie. The plane formed by the first end and the body is set at right angles to the plane formed by the second end and the body.

8 Claims, 2 Drawing Sheets

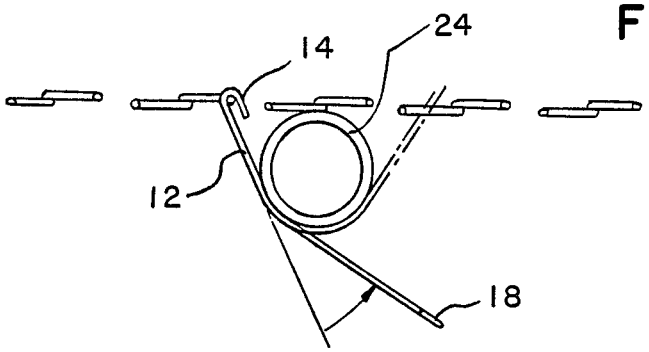
FIG. 6
FIG. 7
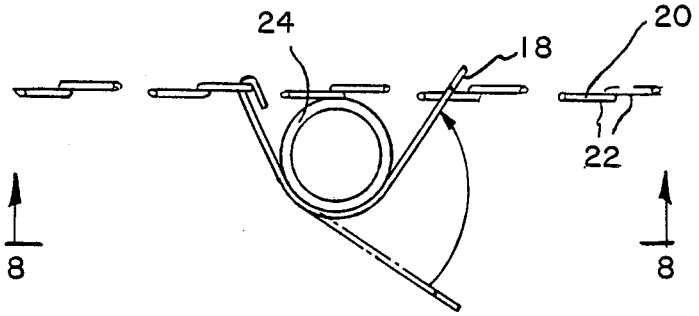
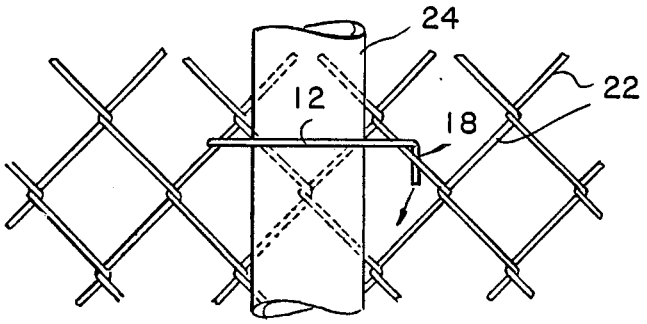
FIG. 8
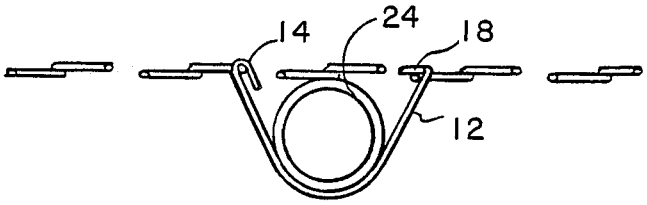
FIG. 10
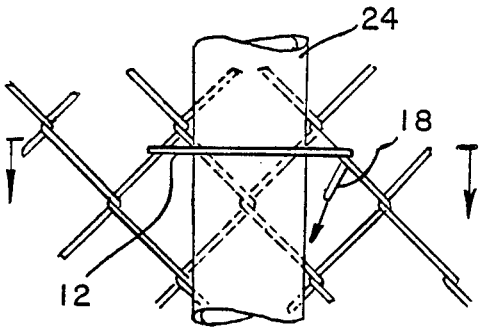
FIG. 9

FENCE-TIE

FIELD OF THE INVENTION

The invention relates to fence-ties used for securing a wire fence to another article such as a post.

BACKGROUND OF THE INVENTION

Wire fences are very old and are part of the common experience of almost everyone. The typical fence is formed of a plurality of wires attached to a series of upright posts which are spaced apart along a line on a surface on which the fence is to be mounted. The wires must be attached to the post in a secure manner, and the attachment must be done efficiently.

Fence-ties have been used for this purpose. A fence-tie in its simplest form is a straight piece of rigid, yet deformable, wire. The first end of the fence-tie is bent into a hook by the fence installer and then hooked over a portion of the fence wire adjacent an upstanding post. The balance of the wire is then bent around the post with the free end being pushed past and over a portion of the wire fence adjacent to and on the opposite side of the post from the first end. The installer then inserts the jaws of a pair of pliers under and beyond the wire portion of the fence to bend the free end of the fence-tie around the wire portion of the fence on which it is resting. The installer then uses the pliers to tighten the first end of the fence-tie around that portion of the wire fence to which it is attached.

The installer must exert a large amount of strength and effort in bending the first end of the fence-tie into a hook, and he must exert even more strength and effort in bending the second end of the fence-tie around the wire fence due to the clumsy, inconvenient position that the second end of the fence-tie is in.

Many solutions have been put forward to solve the problem faced in bending the first end of the fence-tie into a hook for attaching the first end of the fence-tie to the wire fence. These include bending the first end at an angle during the manufacturing of the fence-ties. That is, the first end is prebent as part of the manufacturing process on a machine having appropriate wire bending capabilities. In the prior art the first end has been bent as little as only a few degrees to as much as 180 degrees. The prior art also includes the bending of the first end into a spiral to increase the retention of the first end of the fence-tie on the wire fence. An example of this type of fence-tie is shown in U.S. Pat. No. 2,907,553 issued to Cookman. The prior art also includes deforming the first end of the wire around approximately 180 degrees and then bending the bent over arm of the hook into a "V," with the vertex of the "V" positioned closest to the body of the wire. In this type of fence-tie the hook end is pushed beyond a portion of the fence wire and pulled back so that the fence wire is forced through the gap between the body of the fence-tie and the vertex of the "V" of its hook end to snap fit therein.

In all these embodiments the hook end portion of the fence-tie may be applied to the fence by hand without any tools, except perhaps to tighten the fence-tie upon the fence. In each of these cases, however, the fence-tie is otherwise applied to the fence in the traditional manner. Thus in affixing the second end of the fence-tie to the fence the installer still must use considerable strength and effort to affix the fence-tie to the fence. Also, as discussed above, a substantial amount of time is expended in affixing each fence-tie. If a fence is used to fence in a yard having a parameter of 400 feet (as for a small school yard or construction site) and the posts are disposed one every ten feet, with four fence-ties being applied at each post, it can be seen that the fence-tie installation must occur 160 times. If approximately 30 seconds can be saved in the installation of each fence-tie, over one man hour can be saved in the installation of a fence for a small yard or construction site.

In addition the typical prior art fence-tie must be made extra long in order to enable the installer to be able to grasp the free end of the fence-tie with the jaws of a plier and bend it back around the wire fence. Therefore, in addition to bending the fence-tie around, the excess must be trimmed before the free end can be bent into its final position.

Other fence fastening devices illustrated by the prior art are disclosed in U.S. Pat. No. 2,251,644 issued to Tinnerman, U.S. Pat. No. 1,849,410 issued to Selquist, U.S. Pat. No. 3,169,750 issued to Weed, U.S. Pat. No. 3,246,880 issued to Weed, and U.S. Pat. No. 4,270,581 issued to Claxton, et al.

SUMMARY OF THE INVENTION

The subject invention is a fence-tie formed of a substantially rigid yet deformable material formed as a wire and comprising a substantially straight body having two ends. The first end is formed into a hook and the second end is bent at an angle between 90 and 145 degrees from the body of the fence-tie. The plane formed by the first end and the body is set at right angles to the plane formed by the second end and the body.

BRIEF DESCRIPTION OF THE DRAWINGS

FIG. 6 is a top view of the fence shown in FIG. 1 with the fence-tie of the subject invention being illustrated during an early step in the application of the fence-tie to the fence.

FIG. 7 is a top view of the fence of FIG. 1 showing an intermediate step of the application of the fence-tie to the fence.

FIG. 8 is a front view of the fence of FIG. 1 taken along line 8—8 of FIG. 7 and illustrating the position of the fence-tie after the step illustrated in FIG. 7 has been completed.

FIG. 9 is a front view of the fence in FIG. 1 showing the next step in the application of the fence-tie to the fence after the step illustrated in FIG. 8.

FIG. 10 is a top view of the fence of FIG. 1 with the fence-tie applied thereon.

DETAILED DESCRIPTION OF THE INVENTION

Figure 1:
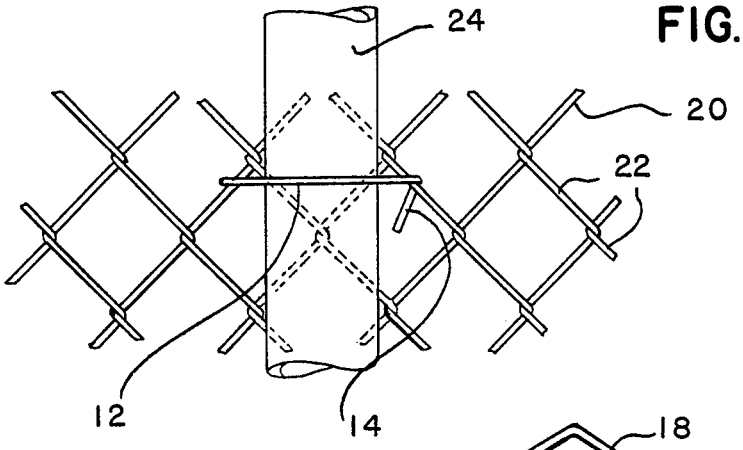
FIG. 1 is a fragmentary view of a part of a fence secured to a post by means of the fence-tie of the subject invention.

The preferred embodiment of the subject invention is illustrated in the drawings. Throughout the drawings the same reference numerals are used to identify the identical elements of the invention.

The fence-tie of the subject invention can be used with virtually any type of wire fence. For purposes of illustration the fence-tie of the subject invention is illustrated in use upon a trellis-type fence 20, shown in FIG. 1, of the kind having a plurality of upright wires 22 bent to interlock with adjacent wires. Post 24 represents one of a series of posts used to support the upright wires of the fence and against which the fence-tie of the subject invention holds the fence. However, the fence-tie of the present invention will work as well on fences having, for example, horizontal rails in place of or in addition to posts, and on fences comprising barbed wire.

Figure 2:
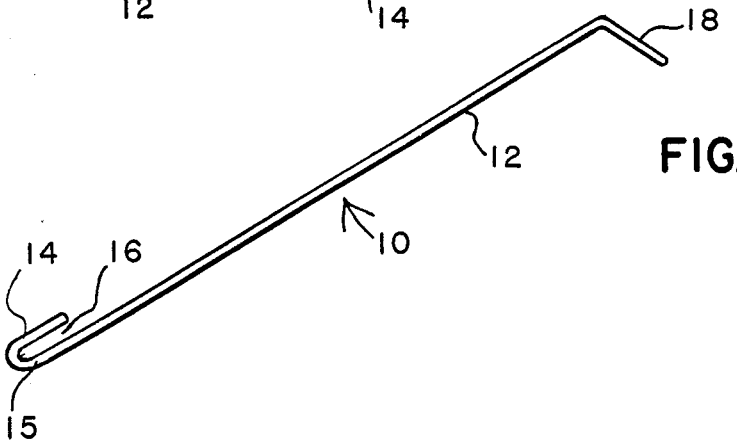
FIG. 2 is a perspective view of the fence-tie of the subject invention.

Referring to FIG. 2, the invention is a fence-tie 10 comprising a body or shaft portion 12 having a hook portion 14 formed at one end of the shaft and an arm portion 18 formed at the other end of the shaft. The fence-tie is formed of 12 gauge aluminum, however, steel or other rigid yet deformable material may be used. By way of example, and without limitation galvanized steel, vinyl clad steel, vinyl clad aluminum, and steel with an aluminum coating may be used. Also, other gauges may be used as well.

The hook end 14 may be formed as a spiral or a snap-fitting "V," or any other member which will enable one end of the tie to be quickly attached to a portion of the wire fence. In the preferred embodiment hook end 14 is formed by simply bending the very end of the fence-tie wire around on itself by 180 degrees. In doing so the terminus of the hook end must be positioned so that the gap 16 between the terminus of the hook end and the shaft portion of the fence-tie is at least as large as the diameter of the fence wire to which it will be attached. The radius of curvature of curve 15 is also large enough to accommodate fence wire.

At the other end of shaft 12 the fence-tie wire is bent to form arm 18. Arm 18 is bent so that the angle between it and the shaft portion is approximately 105 degrees, although fence-ties where the angle between the arm and the shaft is from approximately 90 to approximately 135 degrees would work also.

Figure 3:
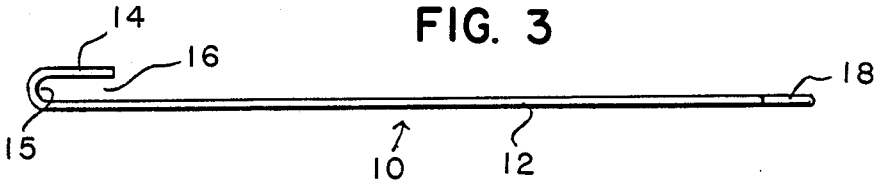
FIG. 3 is a side view of the subject invention.
Figure 4:
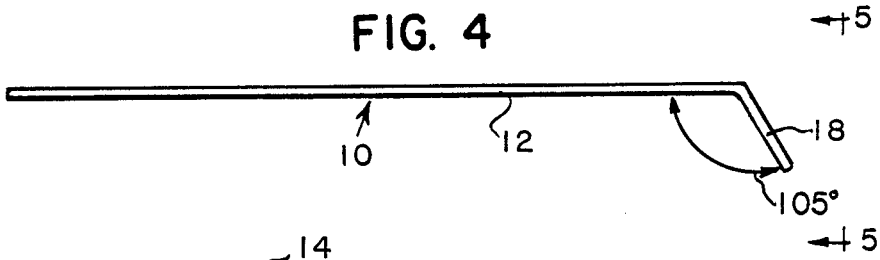
FIG. 4 is a side view of the subject invention turned through 90 degrees about the axis of the body of the fence-tie from that position shown in FIG. 3.
Figure 5:
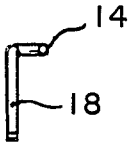
FIG. 5 is an end view of the subject invention taken along line 5—5 of FIG. 4.

As illustrated in FIGS. 3–5 the hook end and the arm portion are disposed so that the plane formed by the hook end and the shaft is approximately perpendicular to the plane formed by the arm member and the shaft. In the preferred embodiment for installers who use tools in their right hands, the arm portion is bent downward in the vertical plane when the fence-tie is disposed such that the hook end lies to the right of the shaft member in the horizontal plane when the fence-tie is viewed from the end toward the hook member as shown in FIG. 5.

FIGS. 6–10 illustrate the application of the fence-tie to a fence. To install the fence-tie of the present invention the installer approaches the fence from the post side thereof. He then inserts the hook end of the fence-tie through the fence on the left side of the post and pulls the fence-tie back until the hook end engages a portion of the fence wire near the post. The shaft portion 12 of the fence-tie extends over the upper portion of the fence wire and then, as shown in FIG. 6, shaft 12 of the fence-tie is bent around post 24.

As illustrated in FIG. 7, the shaft portion is continued to be bent around post 24 until the arm member 18 is extended through the fence 20 on the right side of the post. The fence-tie is positioned so that the shaft 12 extends over a portion of the fence wire on the right side of the post as shown in FIGS. 7 and 8.

With the fence-tie positioned as shown in FIG. 8 it can be seen that the arm 18 extends downward so that it appears in the "window" immediately below the portion of the fence wire to which the arm member is adjacent, and thus the arm member may be easily grasped by the jaws of a pair of pliers inserted through the fence by the installer. The installer then pulls the arm downward and inward toward the post to fix the fence-tie tightly upon the fence. The final position of the fence-tie is shown in FIGS. 9 and 10.

The installer may tighten the fence-tie to the fence even further by squeezing with a pair of pliers the hook end toward the shaft 12 on the left side of the post and the arm member toward the shaft 12 on the right side of the post.

It can be seen that the present invention solves a problem inherent with prior art systems. That is, without arm 18 the end of the shaft extending beyond the fence would be capable of being grasp by the jaws of a plier in only an uncomfortable and clumsy manner. As a result, tightening the fence-tie to the fence was very difficult and time consuming. With the new fence-tie of the present invention tightening the end opposite the hook end to the fence wire is now relatively easy and much quicker.

The present invention is also designed so that the fences can comply with the requirements in jurisdictions which mandate that all projections at the ends of means used to fasten fences to posts extend downward so that children or others attempting to scale a fence who may fall will not be injured on their way down by any upwardly projecting elements.

In the prior art the fence-tie typically had to be made extra long in order to provide some reasonably available gripping surface so that the end opposite the hook end could be grasped and bent downward around the fence wire. In the present invention the extra length is not required at all because arm member 18 exist which is readily grasp by the jaws of a pair of pliers. As a result the extra step of trimming the length of the fence tie before it is completely tightened down is eliminated. Also, since the fence-tie of the subject invention has an arm which is already pre-bent, it is much easier to bend it around the fence wire than it is to bend the end of a straight fence-tie.

The present invention satisfies another requirement, namely that the fence-ties may be kept in a container, such as a bag or a belt holder or a pocket, with the hook end up and be slided out easily from the container. This too aids in the efficiency of installing the fence-ties.

Fence-ties of the present invention may be made in various lengths, usually to accomodate the diameter of the posts used with the fences. In the preferred embodiment, where the fence-tie has a shaft whose length is approximately $5\frac{1}{2}''$, arm 18 is approximately $\frac{5}{8}''$ to $\frac{3}{4}''$ in length and the portion of the hook end which extends back toward the shaft is approximately $\frac{1}{2}''$ to $\frac{5}{8}''$ in length.

Above there has been described a unique fence-tie. It will be understood that various changes of the details, materials, steps, arrangements, parts and uses which have been herein described and illustrated in order to explain the nature of the invention will occur to when may be made by those skilled in the art upon the reading of this disclosure or upon viewing the invention itself, and so such changes are intended to be included within the principles and scope of this invention.

We claim:

1. A fence-tie for securing a fence to a post or rail, said fence-tie having two free ends and formed of rigid yet deformable material and comprising, a shaft having first and second terminal ends, a hook member formed at said first end to provide one free end of said fence-tie, and a substantially linear arm member formed at said second end to provide a second free end of said fence-tie, wherein the angle between said arm member and said shaft is between approximately 90° and approximately 135° and wherein the plane formed by said arm member and said shaft is at approximately a right angle to the plane formed by said hook member and said shaft.

2. The fence-tie of claim 1 wherein said shaft, hook member and arm member are formed of a unitary wire.

3. The fence-tie of claim 2 wherein the angle between said arm member and said shaft is approximately 105°.

4. The fence-tie of claim 3 wherein said fence-tie is formed of aluminum.

5. The fence-tie of claim 3 wherein said fence-tie is formed of steel.

6. The fence-tie of claim 3 wherein said fence-tie is clad with vinyl.

7. The fence-tie of claim 3 wherein said fence-tie is formed of steel with an aluminum coating.

8. A fence comprising a plurality of fence wires, a plurality of means for supporting said fence wires, and fence-tie means for affixing said fence wires to said support means, said fence-fit affixing means having two free ends and being formed of rigid yet deformable material and comprising a shaft having first and second terminal ends, a hook member formed at said first end to provide one free end of said fence-tie, and a substantially linear arm member formed at said second end to provide a second free end of said fence-tie, wherein the angle between said arm member and said shaft is between approximately 90° and approximately 135° and wherein the plane formed by said arm member and said shaft is at approximately a right angle to the plane formed by said hook member and said shaft.

* * * * *

UNITED STATES PATENT AND TRADEMARK OFFICE

CERTIFICATE OF CORRECTION

PATENT NO. : 4,899,990

DATED : 2/13/90

INVENTOR(S) : Winders et al.

It is certified that error in the above-identified patent and that said Letters Patent is hereby corrected as shown below:

col. 06, line 10 delete "fence-fit" insert --fence-tie--

Signed and Sealed this

Sixteenth Day of July, 1991

*Attest:*

HARRY F. MANBECK, JR.

*Attesting Officer*

*Commissioner of Patents and Trademarks*